US010495396B2

(12) United States Patent
Seekins

(10) Patent No.: US 10,495,396 B2
(45) Date of Patent: Dec. 3, 2019

(54) INDEXED ADJUSTABLE GAS BLOCK SYSTEM

(71) Applicant: Glen Dale Seekins, Lewiston, ID (US)

(72) Inventor: Glen Dale Seekins, Lewiston, ID (US)

(73) Assignee: Seekins Precision, LLC, Lewiston, ID (US)

( * ) Notice: Subject to any disclaimer, the term of this patent is extended or adjusted under 35 U.S.C. 154(b) by 0 days.

(21) Appl. No.: 16/137,361

(22) Filed: Sep. 20, 2018

(65) Prior Publication Data

US 2019/0101346 A1 Apr. 4, 2019

Related U.S. Application Data

(60) Provisional application No. 62/561,062, filed on Sep. 20, 2017.

(51) Int. Cl.
*F41A 5/28* (2006.01)

(52) U.S. Cl.
CPC ..... *F41A 5/28* (2013.01)

(58) Field of Classification Search
CPC ..... F41A 5/20; F41A 5/24; F41A 5/26; F41A 5/28; F41A 3/26
USPC ..... 89/191.01–193, 129.01
See application file for complete search history.

(56) References Cited

U.S. PATENT DOCUMENTS

2006/0162716 A1* 7/2006 Dobbins ..... F41A 19/12 124/77
2013/0098235 A1* 4/2013 Reinken ..... F41A 5/28 89/193
2013/0269510 A1* 10/2013 Sullivan ..... F41A 5/28 89/193
2014/0076143 A1* 3/2014 Hall ..... F41A 19/03 89/129.01
2014/0076149 A1* 3/2014 Adams ..... F41A 5/28 89/192
2015/0033934 A1* 2/2015 Hiscock ..... F41A 21/12 89/26
2015/0176933 A1* 6/2015 Adams ..... F41A 5/28 89/191.02
2015/0226502 A1* 8/2015 Beaty ..... F41A 5/28 89/193
2015/0241149 A1* 8/2015 McMillen, IV ..... F41A 5/28 89/193
2015/0330729 A1* 11/2015 Adolphsen ..... F41A 5/20 89/193
2016/0076836 A1* 3/2016 Young ..... F41A 5/28 89/194
2017/0299326 A1* 10/2017 Seekins ..... F41A 21/482

* cited by examiner

*Primary Examiner* — Michael D David
(74) *Attorney, Agent, or Firm* — Hogaboam Law Offices, PLLC; Romney J. Hogaboam

(57) ABSTRACT

Adjustable gas block system for a repeating firearm having an indexed adjustment system which may be pre-set for a desired amount of gas flow and then adjusted over a range of gas flow by manipulating a lever.

15 Claims, 6 Drawing Sheets

INDEXED ADJUSTABLE GAS BLOCK SYSTEM

CROSS-REFERENCE TO RELATED APPLICATIONS

This application claims priority to provisional application 62/561,062 filed on Sep. 20, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

The invention relates generally to gas operating system components for semi-automatic and automatic firearms. Many people own own firearms for various purposes including, but not limited to, protection, trade, hunting, recreation, collecting, and sporting.

Semi-automatic and automatic firearms offer a number of benefits over manually operated firearms. Semi-automatic and automatic firearms generally permit an operator to fire rounds more rapidly than do manually operated firearms. Semi-automatic firearms also generally impart a less harsh recoil impulse to an operator.

A variety of operating systems are employed by semi-automatic and automatic firearms including, but not limited to, blow-back, piston, and direct impingement. A blow-back operating system is generally used on lower pressure cartridges. Piston and direct-impingement operating systems are generally used on higher pressure cartridges. Piston and direct-impingement operating systems are generally used on locking bolt firearms. Piston and direct-impingement operating systems generally rely on a hole, called a gas port, between the chamber and the muzzle of the barrel. When the firearm is fired, a primer ignites powder in the cartridge generating gas. The expanding gas causes pressure to increase forcing the bullet to leave the cartridge and travel down the barrel. Once the bullet passes the port, some of the gas flows out the gas port activating the operating system.

Many direct-impingement operating systems are not user-adjustable. These operating systems rely on allowing sufficient gas to enter the operating system to allow cartridges within a particular band of pressures to successfully activate the operating system. This results in the operating system commonly having excessive operating force under certain conditions causing greater than necessary perceived recoil and equipment wear. This can also result in the operating system having insufficient operating force and not reliably functioning in certain other conditions.

An optimally adjusted operating system allows an appropriate range of loads (bullet weight, velocity, and powders) to cycle the firearm. It also minimizes, or eliminates, excessive energy transferred into the operating system thereby reducing wear on the firearm and perceived recoil to the operator. The amount of gas required to operate the operating system of a firearm can vary based on a number of factors. Installing a suppressor on a firearm generally increases the amount of gas sent through the operating system of a firearm so a previously optimally tuned firearm is likely to be "over-gassed." Shooting slower ammunition (e.g. subsonic) ammunition can send less gas through the operating system so a previously optimally tuned firearm is likely to be "under-gassed."

Some user-adjustable piston operating systems comprise an indexed multi-position mechanism. These allow the user to adjust the amount of gas directed into the operating system and permit it to operate successfully with a wider range of ammunition. Many user-adjustable operating systems can become difficult, or impossible, to adjust if they become excessively fouled. Fouling can occur when carbon or other materials in the gas are deposited in the operating system.

DESCRIPTION OF RELATED ART INCLUDING INFORMATION DISCLOSED UNDER 37 CFR 1.97 AND 37 CFR 1.98

Not Applicable

BRIEF SUMMARY OF THE INVENTION

An indexed adjustable gas block system which is adjustable using a lever which may be installed in various positions according to the need of the user and which minimizes fouling of the indexing portion of the operating system.

DETAILED DESCRIPTION OF THE INVENTION

Figure 1:
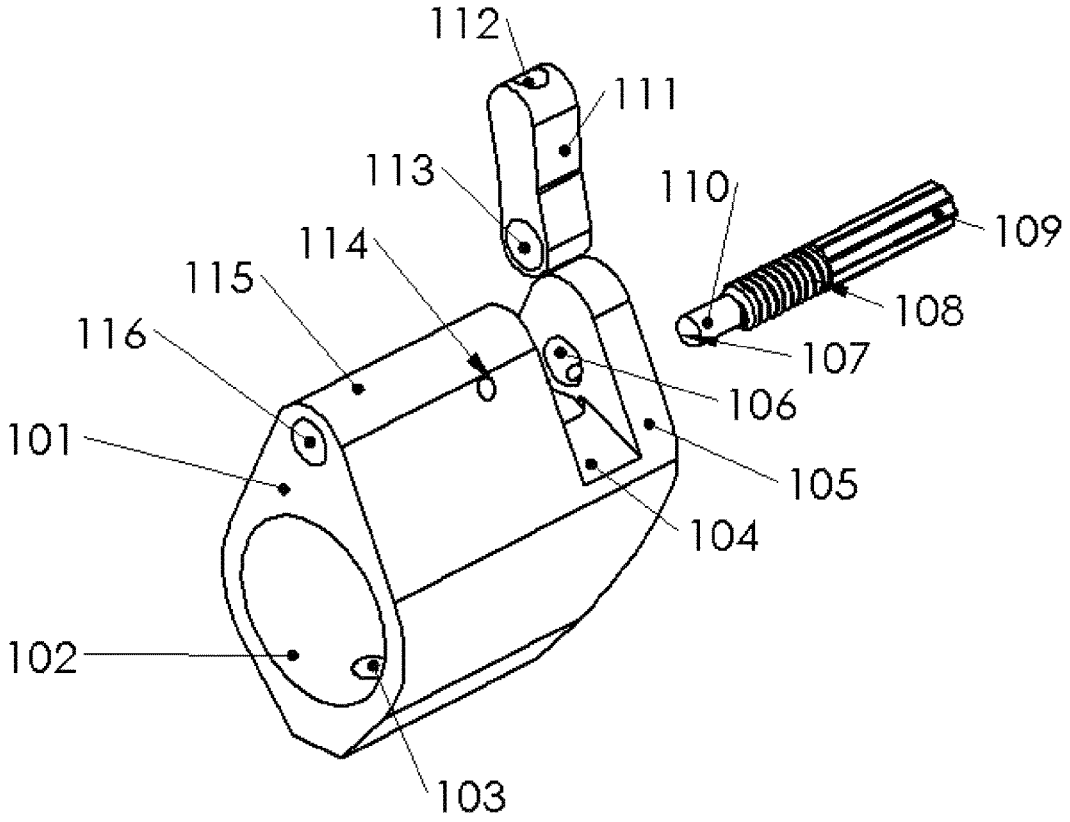
FIG. 1 is an exploded view of the applicant's invention from the top breech perspective.
Figure 2:
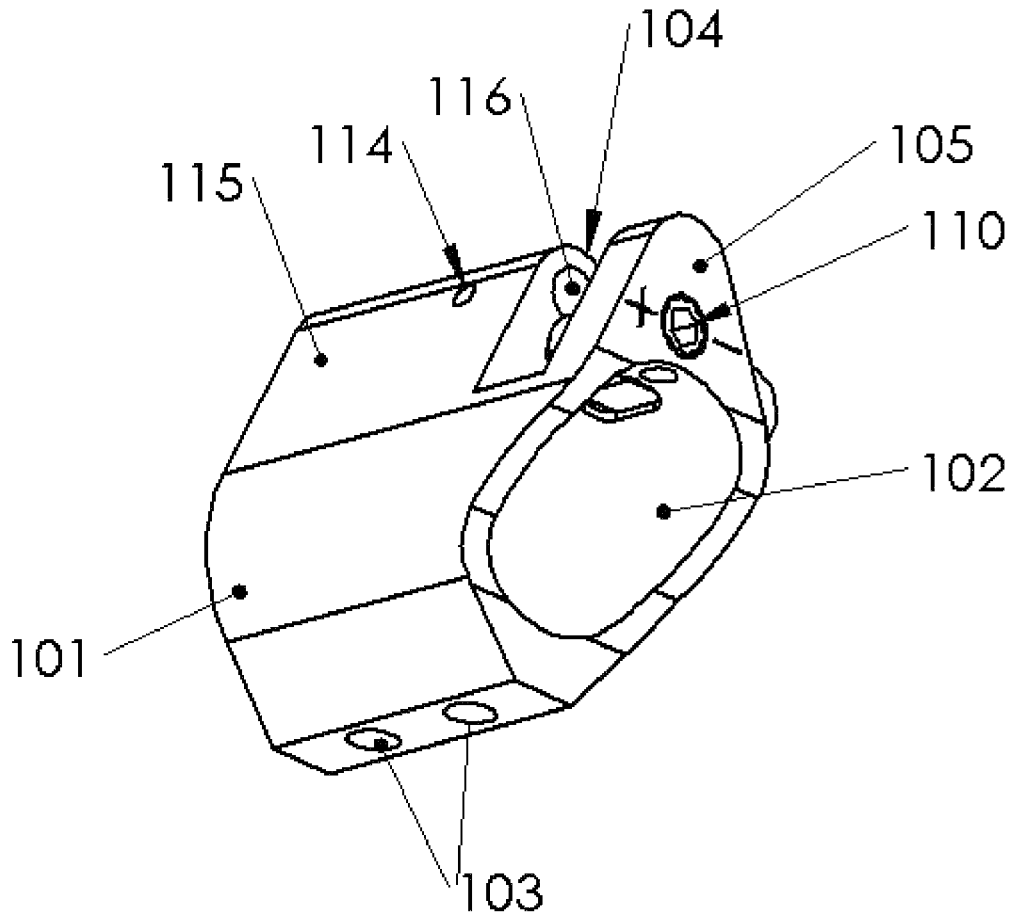
FIG. 2 is a perspective view of the applicants from the lower-muzzle end.
Figure 3:
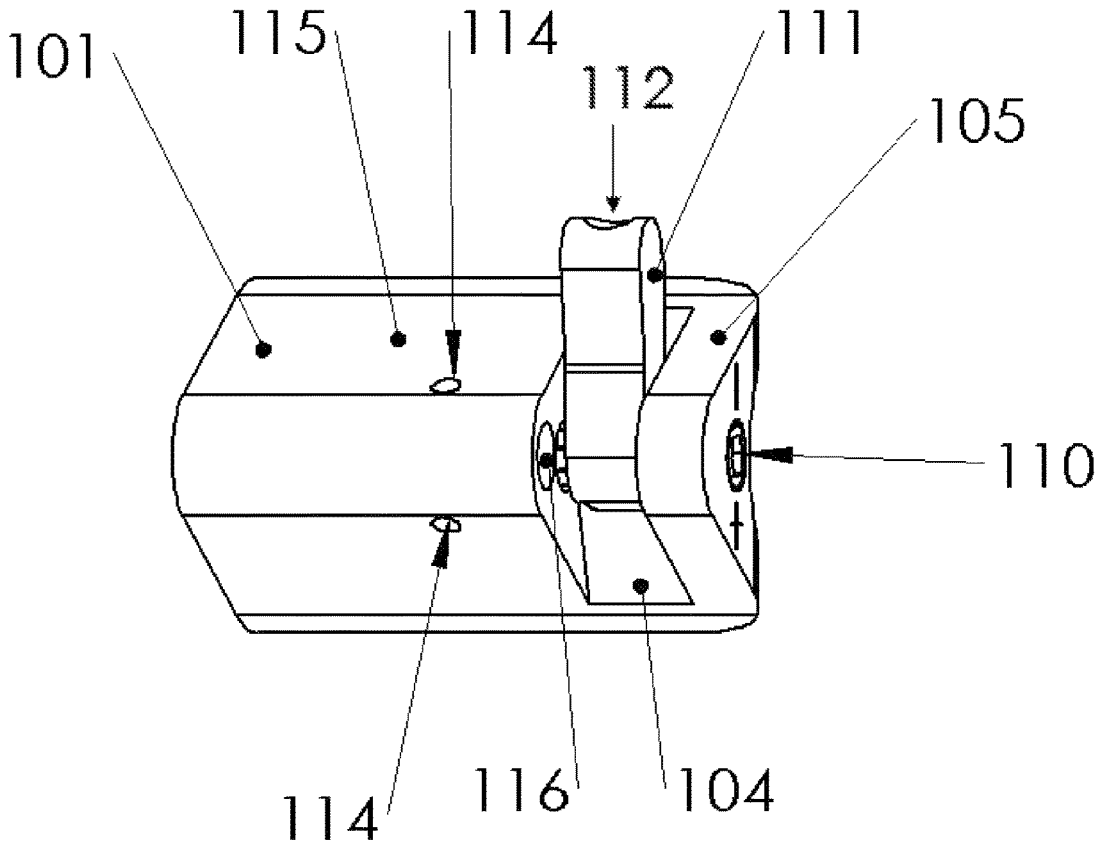
FIG. 3 is a perspective view of the applicant's invention from the top.
Figure 4:
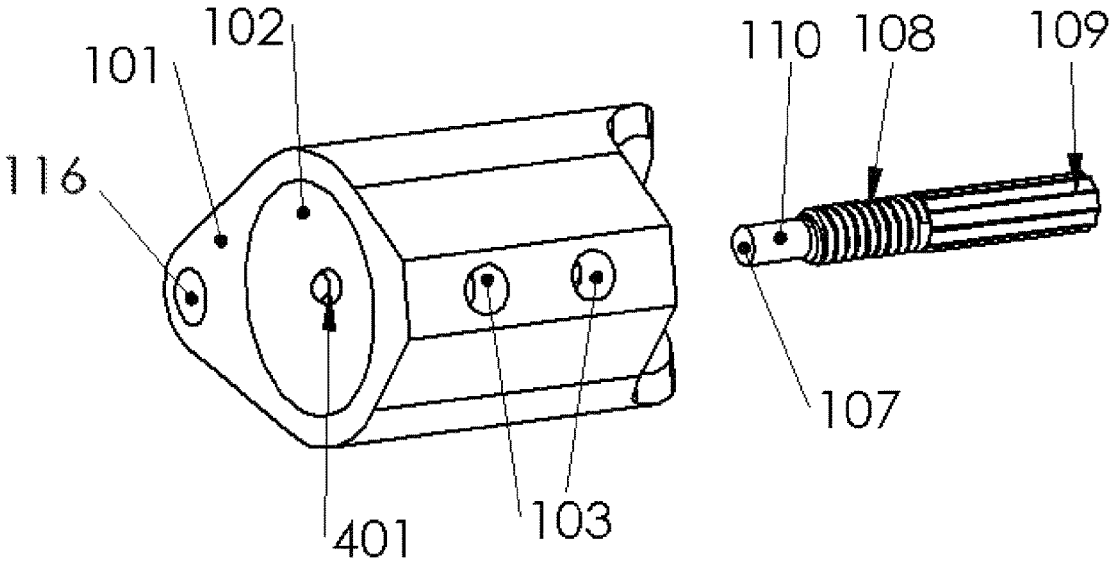
FIG. 4 is an exploded perspective view of the applicant's invention from the bottom.
Figure 5:
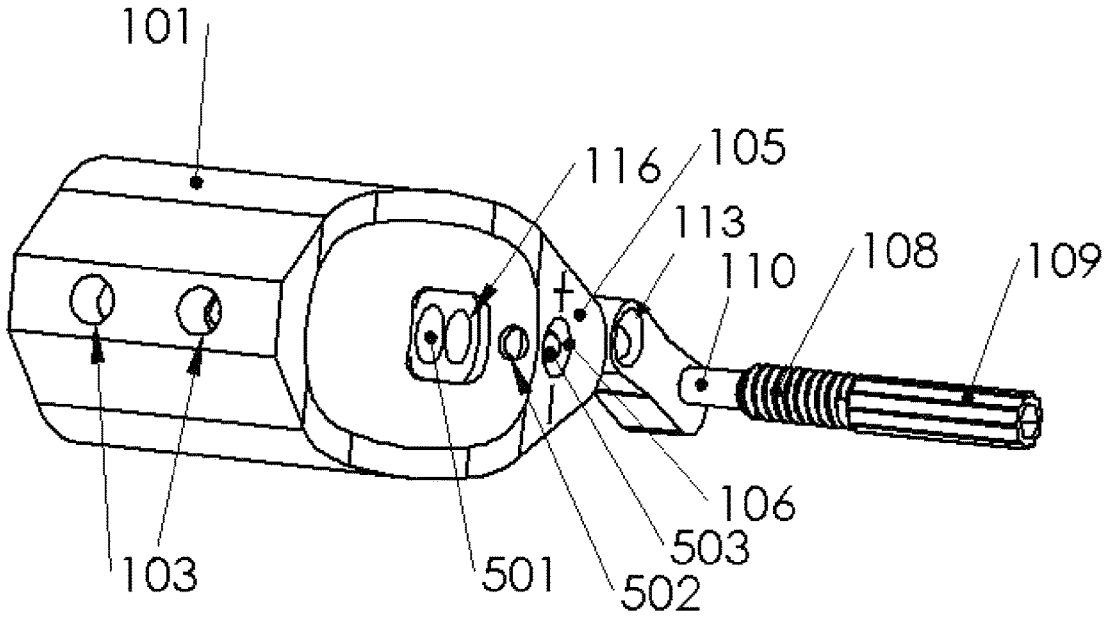
FIG. 5 is an exploded perspective view of the applicant's invention from the lower muzzle end.
Figure 6:
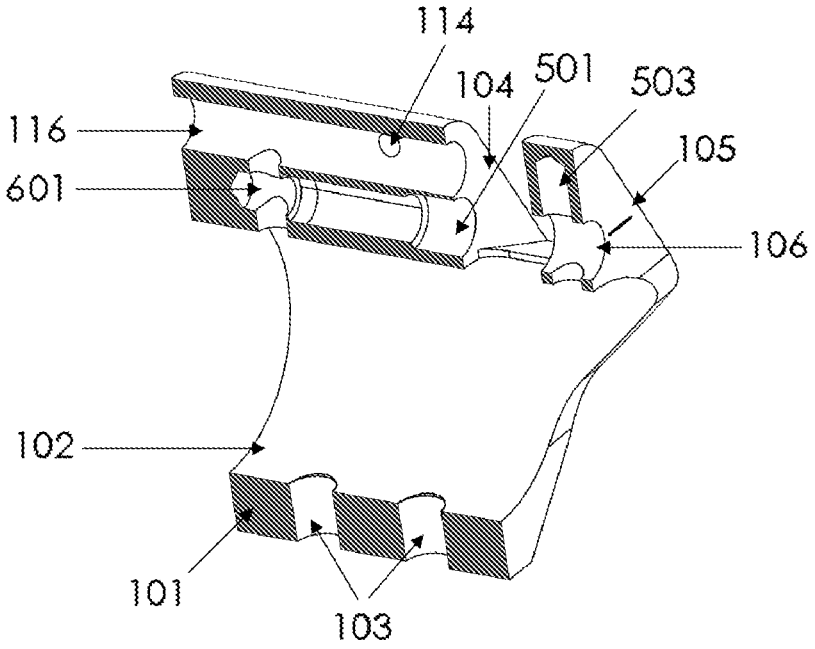
FIG. 6 is a horizontal section view of the applicant's invention from the side.

The applicant's invention is an indexed adjustable gas block for a firearm. The gas block may be used in piston or direct impingement firearms. The gas block is comprised of three primary elements: a body 101, a handle 111, and an adjustment screw 110. The body 101 is configured with a barrel hole 102 configured to accept passage of a firearm barrel. The body 101 contains features to allow the body 101 to be secured to a firearm barrel. In a preferred embodiment, those features are one or more threaded barrel attachment holes 103 passing through the body perpendicular to the barrel hole. The body is configured with a slot 104 separating a biasing portion 105 of the body 101 from a gas portion 115 of the body 101. The biasing portion 105 of the body 101 is configured with an adjustment screw passage hole 106 configured to permit an adjustment screw 110 to pass through the biasing portion 105 of the body 101. In a preferred embodiment, the adjustment screw passage hole 106 is smooth rather than threaded. The gas portion 115 of the body 101 is configured with a gas tube hole 116 (exit gas port) parallel to the barrel hole. The gas tube hole 116 is connected to the barrel hole 102 by an obstruction cavity 601 (an opening configured to accept the tip 107 of the adjustment screw 110) which is connected to the a gas port 401 (entry gas port). Gas may travel from the entry gas port 401, through the obstruction cavity 601, and then through the gas tube hole 106. The gas portion 115 of the body 101 may be further configured with a gas tube pin hole 114 perpendicular to the gas tube hole 116. The gas tube pin hole 114 is positioned such that when a gas tube roll pin is inserted into the gas tube roll pin hole 114, the roll pin partially encroaches into the gas tube hole 116. In an alternative embodiment, the exit gas tube port is configured to operate on a piston system rather than a direct impingement system.

The biasing portion 105 of the body 101 is configured with a detent installation hole 502 which connects the barrel hole 102 to the adjustment screw passage hole 106. The biasing portion 105 of the body 101 is further configured with a detent hole 503. The detent hole 503 is configured to accept a biasing member and an interfacing member. In a preferred embodiment, the biasing member is a spring and the interfacing member is a ball bearing where the spring is installed between the ball bearing and end of the detent hole farthest from the barrel hole.

A handle 111 is configured to attach to the adjustment screw 110. The handle 111 has a thickness less than the width of the gap 104 separating the gas portion 115 of the body 101 from the detent portion 105 of the body 101. The handle 111 is configured with an adjustment screw passage hole 113 passing through the thickness of the handle 111. The handle 111 is also configured with an adjustment screw attachment hole 112 passing through the length of the handle terminating in the adjustment screw passage hole 113. In a preferred embodiment, the adjustment screw attachment hole 112 is threaded. The handle 111 may be attached to the adjustment screw 110 by tightening a screw into the adjustment screw attachment hole 112. In a preferred embodiment, a first headless screw is tightened into the adjustment screw attachment hole 112 and a second headless screw is tightened into the adjustment screw attachment hole 112 against the first headless screw as a jam screw to prevent both headless screws from accidentally loosening.

The adjustment screw 110 is comprised of a threaded portion 108, an indexing portion 109, and a tip 107. The threaded portion is threaded to cooperatively interface with threads contained in the adjustment screw adjustment hole 501. Adjustment screw adjustment hole 501 terminates in the obstruction cavity 601 in the gas portion 115 of the body 101 on the side of gas port 401 opposite the detent portion 105 of the body 101. In a preferred embodiment, the diameter of the shaft of the tip 107 portion of the adjustment screw 110 is approximately equal to the width of the obstruction cavity 601 of the gas block such that when the tip 107 portion of the adjustment screw 110 passes through the obstruction cavity 601 of the gas block 101 to its maximum extent, gas is substantially prevented from passing through the obstruction cavity 601 of the gas block 101 into the gas tube hole 116. The adjustment screw 110 is further comprised of an indexing portion 109. In a preferred embodiment, the indexing portion 109 of the adjustment screw 110 is comprised of a series of lengthwise grooves. In an alternative embodiment, the indexing portion 109 is comprised of a series of flat regions. The shape of the indexing portion 109 is selected to cooperatively interface with the end of a headless screw used to attach the handle 111 to the adjustment screw 110. The shape of the indexing portion 109 is also selected to cooperatively interface with an interfacing member (detent) installed in the biasing portion 105 of the body 101. The thread pitch of the threaded portion 108 of the adjustment screw 110 is selected in conjunction with the spacing of the lengthwise grooves in the indexed portion 109 such that a desirable amount of insertion or removal of the tip portion 107 of the adjustment screw 110 from the obstruction cavity 601 is achieved as sequential features in the indexed portion 109 of the adjustment screw 110 face the detent hole 503. In a preferred embodiment, the end of the adjustment screw 110 opposite the tip 107 portion is configured with a features, such as a hexagonal depression or slot, to facilitation insertion of a tool to aid in rotating the adjustment screw 110.

The invention is used by inserting a biasing member and an interfacing member (detent) into the detent hole 503. The interfacing member is held in place, with a tool if necessary through the detent installation hole 502, while the adjustment screw 110 is inserted through the adjustment screw passage hole 106 thereby capturing the interfacing member and biasing member. The adjustment screw 110 is then further pushed through the adjustment screw passage hole 113 and into the adjustment screw adjustment hole 501 until the threads of the adjustment screw 110 meet the threads of the adjustment screw adjustment hole 501. The adjustment screw 110 is then screwed into the adjustment screw adjustment hole 501 to the desired depth which results in the desired amount of opening in the obstruction cavity 601.

The handle 111 is then attached to the adjustment screw 110. This is preferably achieved by screwing a first headless screw into the adjustment screw attachment hole 112 until the end of the screw closest the adjustment screw fits against or in a feature in the indexing portion 109 of the adjustment screw 110. A second headless screw is then screwed into the adjustment screw attachment hole 112 until the second headless screw contacts the first headless screw such that the second headless screw acts as a jam screw. A user may then rotate the handle 111, thereby rotating the adjustment screw HO, to increase or decrease the amount of the obstruction cavity 601 obstructed by the tip 107 portion of the adjustment screw 110. Increasing the amount of the obstruction cavity 601 obstructed by the tip 107 portion of the adjustment screw 110 will decrease the amount of gas permitted to pass from the entry gas port 401 into the gas tube hole 116. Decreasing the amount of the obstruction cavity 601 obstructed by the tip 107 portion of the adjustment screw 110 will increase the amount of gas permitted to pass from the barrel through the entry gas port 401 into the gas tube hole 116.

A gas tube is then inserted into the gas tube hole 116 to the desired depth. A roll pin is then driven into the gas tube pin hole 114 thereby capturing the gas tube. The body 101 is then installed on a barrel with the barrel passing through the barrel hole 102. The body 101 is then secured on the barrel. In a preferred embodiment, the body is secured on the barrel by one or more screws threaded into one or more barrel attachment holes 103 where the ends of the screw(s) contact the barrel. Other means of attaching the gas block, including clamp-type and two-piece gas blocks are well known in the art and may be used without deviating from the present invention.

The invention claimed is:

1. An adjustable gas block system for a semi-automatic firearm comprising:

a) a gas block configured to be attached to a firearm barrel having a gas port comprising:
   1) an entry gas port configured to allow gas to enter the gas block from the firearm barrel gas port,
   2) an exit gas port configured to allow gas to exit the gas block,
   3) an obstruction cavity disposed between the entry gas port and the exit gas port fluidly connected to both the entry gas port and the exit gas port;

b) an adjustment screw comprising:
   1) threads configured to cooperatively interact with threads in the gas block,
   2) a gas restricting portion wherein movement of the adjustment screw within the gas block alters the volume of obstruction cavity open to the passage of gas from the entry port to the exit port, and
   3) an indexing portion; and c) an adjustment handle, having a physically-limited range of motion, configured to be attached to the adjustment screw in a plurality of orientations wherein:
   1) the physically-limited range of motion of the adjustment handle at a first extreme prevents movement beyond that which causes the gas restricting portion of the adjustment screw to occupy a user-configurable minimal volume of the obstruction cavity of the gas block,
   2) the physically-limited range of motion of the adjustment handle at a second extreme prevents movement beyond that which causes the gas restricting portion of the adjustment screw to occupy a user-configurable maximal volume of the obstruction cavity of the gas block, and
   3) the orientation of the adjustment handle relative to the adjustment screw is user-configurable and selected to cause the desired volume of obstruction cavity open to the passage of gas be achieved at an extreme of the physically-limited range of motion of the adjustment handle.

2. The adjustable gas block system of claim 1 further comprising a biasing system.

3. The adjustable gas block system of claim 2 wherein the gas block further comprises a slot approximately orthogonal to the firearm barrel and through which the adjustment screw passes.

4. The adjustable gas block system of claim 3 wherein the slot in the gas block is disposed between the biasing system and the obstruction cavity.

5. The adjustable gas block system of claim 2 wherein the biasing system comprises:

a) a biasing member configured to interface with the indexing portion of the adjustment screw and resist rotation of the adjustment screw; and b) a pressure applying means configured to apply pressure on the biasing member.

6. The adjustable gas block system of claim 5 wherein the pressure applying means comprises:

a) a cavity in the gas block beginning at a location selected to correspond with the indexing portion of the adjustment screw and ending in the gas block; and b) a spring which applies pressure on the end of the cavity ending in the gas block and the biasing member.

7. The adjustable gas block system of claim 4 wherein the adjustment handle attaches to the adjustment screw in the portion of the adjustment screw passing through the slot in the gas block.

8. The adjustable gas block system of claim 4 wherein the adjustment handle extends beyond an outer perimeter of the gas block when the adjustment handle is installed on the adjustment screw.

9. The adjustable gas block system of claim 4 wherein the adjustment handle does not extend beyond an outer perimeter of the gas block when the adjustment handle is installed on the adjustment screw.

10. The adjustable gas block system of claim 4 wherein the adjustment handle attaches to the indexing portion of the adjustment screw by means of a threaded member passing down a tapped hole traversing at least a portion of the length of the adjustment handle to interface with the indexing portion of the adjustment screw.

11. The adjustable gas block system of claim 10 wherein the threaded member attaching the adjustment handle to the adjustment screw is secured by a jam screw.

12. The adjustable gas block system of claim 1 wherein the indexing portion of the adjustment screw comprises a plurality of longitudinal grooves.

13. The adjustable gas block system of claim 1 wherein the indexing portion of the adjustment screw has a polygonal cross-section.

14. The adjustable gas block system of claim 1 wherein the threaded portion of the adjustment screw comprises multiple start threads.

15. A method of tuning the adjustable gas block system of claim 1 comprising:

a) installing the adjustment screw into the gas block until the gas restricting portion of the adjustment screw leaves open the desired volume of obstruction cavity open to the passage of gas from the entry port to the exit port; and b) attaching the adjustment handle to the adjustment screw at a desired orientation.

* * * * *